US011668166B2

(12) United States Patent
Lopez de Cardenas et al.

(10) Patent No.: US 11,668,166 B2
(45) Date of Patent: Jun. 6, 2023

(54) OILFIELD PERFORATING SELF-POSITIONING SYSTEMS AND METHODS

(71) Applicants: Harrison Jet Guns II, L.P., Kennedale, TX (US); ResEnTech, LLC, Sugar Land, TX (US)

(72) Inventors: Jorge E. Lopez de Cardenas, Sugar Land, TX (US); Timothy A. Andrzejak, Sugar Land, TX (US); James F. Shelton, Kennedale, TX (US)

(73) Assignees: Harrison Jet Guns II, L.P., Kennedale, TX (US); ResEnTech, LLC, Sugar Land, TX (US)

( * ) Notice: Subject to any disclaimer, the term of this patent is extended or adjusted under 35 U.S.C. 154(b) by 0 days.

(21) Appl. No.: 17/471,390

(22) Filed: Sep. 10, 2021

(65) Prior Publication Data

US 2022/0074289 A1 Mar. 10, 2022

Related U.S. Application Data

(60) Provisional application No. 63/076,670, filed on Sep. 10, 2020.

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC ... E21B 43/117; E21B 43/1185; E21B 43/119
See application file for complete search history.

(56) References Cited

U.S. PATENT DOCUMENTS 2,847,075 A * 8/1958 Halbrook ..... E21B 23/00 166/243
3,933,203 A * 1/1976 Evans ..... E21B 17/1035 166/241.6
4,153,118 A * 5/1979 Hart ..... E21B 43/119 175/4.51
4,194,577 A * 3/1980 Vann ..... E21B 43/11855 166/50
4,637,478 A * 1/1987 George ..... F42B 3/08 175/4.54

(Continued)

FOREIGN PATENT DOCUMENTS

CN 103806880 A * 5/2014
RU 178932 U1 * 4/2018

(Continued)

*Primary Examiner* — Daniel P Stephenson
(74) *Attorney, Agent, or Firm* — Warner Norcross + Judd LLP

(57) ABSTRACT

A self-positioning system for a perforating gun or gun string is provided. The self-positioning system includes a plurality of protrusions extending outwardly from the perforating gun or the gun string for providing a finite number of rotational positions and/or for providing a desired water clearance. The protrusions include one or more groupings of at least three protrusions, the protrusions being angularly offset from each other about the outer circumference of the perforating gun or gun string.

16 Claims, 17 Drawing Sheets

(56) References Cited

U.S. PATENT DOCUMENTS 4,919,208 A * 4/1990 Schneider ..... E21B 17/1028 166/241.1
5,107,927 A * 4/1992 Whiteley ..... E21B 17/10 166/227
5,603,379 A * 2/1997 Henke ..... E21B 43/1185 175/4.51
6,508,307 B1 * 1/2003 Almaguer ..... C09K 8/68 166/308.1
6,591,911 B1 * 7/2003 Markel ..... E21B 43/117 166/55.2
6,672,405 B2 * 1/2004 Tolman ..... E21B 43/14 175/4.51
6,942,033 B2 9/2005 Brooks et al.
7,000,699 B2 2/2006 Yang et al.
7,857,063 B2 * 12/2010 Thornton ..... E21B 43/103 166/207
8,181,718 B2 * 5/2012 Burleson ..... E21B 43/119 175/4.51
8,555,964 B2 * 10/2013 MacLeod ..... E21B 17/1078 166/241.1
9,115,572 B1 8/2015 Hardesty et al.
9,297,228 B2 * 3/2016 Martinez ..... E21B 43/119
9,404,617 B2 * 8/2016 Sartiaux ..... E21B 17/1035
9,745,803 B2 * 8/2017 Buytaert ..... E21B 17/1078
11,326,410 B2 * 5/2022 Wutherich ..... E21B 47/024
11,384,625 B2 * 7/2022 Roessler ..... E21B 43/117
11,391,127 B1 * 7/2022 Hoelscher ..... E21B 43/116
2002/0185275 A1 * 12/2002 Yang ..... E21B 17/1057 166/50
2003/0150611 A1 * 8/2003 Buytaert ..... E21B 17/1028 166/241.6
2011/0024117 A1 * 2/2011 Lopez De Cardenas ..... E21B 43/119 166/298
2015/0226044 A1 * 8/2015 Ursi ..... E21B 43/117 166/55
2022/0074289 A1 * 3/2022 Lopez de Cardenas ..... E21B 43/119

FOREIGN PATENT DOCUMENTS

WO WO-2021191275 A1 * 9/2021 ..... E21B 43/116
WO WO-2022155497 A1 * 7/2022

* cited by examiner

OILFIELD PERFORATING SELF-POSITIONING SYSTEMS AND METHODS

CROSS-REFERENCE TO RELATED APPLICATIONS

This application claims the benefit of U.S. Provisional Application 63/076,670 filed Sep. 10, 2020, the disclosure of which is incorporated by reference in its entirety.

TECHNICAL FIELD

The technical field generally relates to oilfield perforating gun systems and methods for positioning them downhole in a well. More particularly, the technical field relates to gun features, methods, and accessories used to create a self-positioning gun string in deviated or horizontal wells.

BACKGROUND

"Cased-hole" oil and gas wells are constructed by drilling into a formation to form a wellbore, inserting metal casing into the wellbore, and sealing the casing in the wellbore using cement. Perforations into a hydrocarbon payzone are then created to allow communication of fluids between the hydrocarbon payzone in the formation and the cased-hole well. The perforations are commonly generated using shaped charges, which are directional explosive devices that, upon detonation, generate a high velocity mass of material. Conical shaped charges are typically used for oilfield perforating whereby, upon detonation, an interior cone of material collapses and is formed into a high-velocity jet that penetrates through the well casing. The shaped charges are mounted in a perforating gun that is conveyed into a well on either a cable (e.g., an electric wireline or slick line) or tubing (e.g. production tubing, drill pipe, or coiled tubing). FIG. 1 is an illustration of a conventional oilfield perforating gun 6 that is conveyed into a well 3 using a wireline cable 1. As shown in FIG. 2, the main components in a typical perforating gun include: (1) a loading tube into which the shaped charges are secured, (2) a gun carrier that protects the internal components from the wellbore fluids, and (3) a gun adapter that seals the gun carrier and secures the perforating gun to other components in the tool string.

As shown in FIGS. 1 and 2, conventional perforating guns contain multiple conical shaped charges 7. The individual conical shaped charges 7 within the perforating gun are ballistically connected via a length of detonating cord. Conventional perforating guns 6 also contain a detonator (not shown in FIG. 1) that is installed in operative communication with the detonating cord. Detonators can detonate the shaped charges 7 in a variety of manners, including by providing an electrical signal, a pressure pulse, a pyrotechnic fuse, and/or a percussion/impact. Upon activating the detonator, a detonation wave passes along the detonating cord that sequentially detonates each conical shaped charge 7 within the perforating gun 6. A high velocity linear jet produced from each conical shaped charge 7 creates a perforation hole through the well casing and cement 2 and into the hydrocarbon payzones 5 of the formation.

"Well Completion" is a term that collectively refers to the oilfield well-construction activities that prepare a given well for hydrocarbon production and includes the operations of cementing and perforating. During Well Completion operations, it may be desirable to perforate at different spatial intervals within a well. Scenarios where this may be desirable include: (1) vertical or deviated wells with multiple hydrocarbon payzones 5, (2) vertical or deviated wells that are being hydraulically fractured, and (3) horizontal wells that are being hydraulically fractured. To achieve a higher operational efficiency in these situations, conventional approaches have involved conveying multiple perforating guns 6 together in a single tool string into the well 3. A common method for conveying multiple guns 6 into a well 3 is to connect the guns 6 to the wireline cable 1 on a single downhole tool string.

Hydraulic fracturing is a technique sometimes used in the oilfield to access and produce low-permeability payzones 5. Hydraulic fracturing generally involves pumping a fluid into a well 3 at high pressure, which traverses through the well's perforations and into the payzone 5. The high-pressure fluid produces fractures within the payzone 5 to improve the efficiency of hydrocarbon extraction. Horizontal wells with multiple hydraulic fractures are typically desired to economically extract hydrocarbons from shale reservoirs because of the inherent low permeability. As shown in FIG. 3, hydraulic fracturing operations in horizontal wells typically involve multiple stages. Each hydraulic fracturing stage utilizes multiple perforating guns 6 to generate perforation clusters at different intervals along the well. Typically, a perforating cluster may contain as few as one or as many as 30 or more perforations. This process is commonly referred to as "multi-stage" hydraulic fracturing.

It has been established that perforation holes generated by conical shaped charges are useful for optimizing hydraulic fracturing operations and hydrocarbon production. Perforating guns are typically de-centralized when conveyed in a given well because of the force of gravity, with the perforating gun offset from a center axis of the well casing and leaning against one side of the casing. As shown in FIG. 4, a de-centralized perforating gun results in different water stand-off distances for conical shaped charges shot at different gun phases. A gun phase is defined as a particular angle along the circumference of the perforating gun relative to a reference direction. The gun phasing in the example shown in FIG. 4 is 60-degrees, meaning each phase is at an angle of 60-degrees from the neighboring phase. Conventional conical shaped charges typically generate a large variation in perforation hole size in the well casing owing to the variation in water stand-off distances among the different perforation phases. Higher variation in perforation hole size can result in less efficient hydraulic fracturing operations owing to the smaller holes yielding a higher pressure drop when fluids are pumped through the perforation holes. This in turn allows the larger perforation holes to receive most of the fracturing fluid, leading to substantially lower or negligible flow through the smaller perforating holes. The impact of perforations with different casing entrance hole sizes is evident from the below equation that calculates the pressure drop (psi) of a liquid passing through a hole in the casing ($P_{pf}$, often called "perforation friction"), where the pressure drop is inversely proportional to the hole diameter to the fourth-power. In the equation below, Q is the flow rate (BPM), SG is the specific gravity of the fluid, D is the casing EH diameter (inches), $C_d$ is the discharge coefficient, and N is the number of perforations taking fluid.

$$P_{pf} = \frac{0.2369 \cdot Q^2 \cdot SG}{D^4 \cdot C_d^2 \cdot N^2}$$

Tool string positioning devices have been used primarily in vertical wells, and examples of such devices are shown in FIG. 5. These positioning devices can be used to centralize the tool string near the center axis of the well casing or to maintain contact between the tool string and the inside of the casing. There also exist magnetic positioning devices that can be used in place of the leaf spring positioning devices shown in FIG. 5. Positioning devices are sometimes used for perforating in vertical or slightly deviated wells when smaller perforating guns are used to pass-through production tubing. When employing magnetic positioning devices, the shaped charges are typically shot in a single gun phase that is aligned with the side of the well casing where the gun is maintained in contact. The majority of perforating guns, however, typically have the shaped charges mounted in multiple gun phases, in which case positioning the gun against one side of the well casing is not particularly beneficial. Additionally, the use of leaf springs to centralize perforating guns is typically not attractive owing to their cost and susceptibility to damage from detonation of the perforating guns. Furthermore, in highly deviated and horizontal wells, the use of conventional gun positioning devices is normally impractical because of the weight of the gun string.

The use of collars or standoffs is not attractive for perforating guns because, for example, in horizontal and highly deviated wells the perforating gun can rotate when conveyed in the well, and many different water clearances would still be observed by the charges as illustrated in FIG. 6.

Instead of using mechanical standoffs or centralizers to achieve a more uniform perforation hole sizes in the casing, shaped charge manufacturers have developed conical shaped charges that are less sensitive to the varying water standoff distances between the gun and well casing. These types of shaped charges are typically referred to as "uniform hole" shaped charges. Ideal perforation hole sizes for hydraulic fracturing applications are typically between 0.25-0.45 inches in diameter. A desirable standard deviation of the hole size diameter across all gun phases for uniform hole shaped charges is typically less than 0.02 inches or less than 7.0%. The technology and fabrication methods for uniform hole shaped charges has resulted in better perforation holes for optimizing hydraulic fracturing operations. FIG. 7 provides a comparison of perforations generated by uniform hole shaped charges to those produced by shaped charges designed for maximum average hole size. While uniform hole shaped charge technology has been a substantial advancement, it does have limitations. For example, the technology can only compensate for up to a certain range of water clearances, such as up to around 2 inches. The cost of uniform hole shaped charges is also typically higher than other conventional charges.

As shown in FIG. 8, some existing oilfield perforating guns 300 may locate multiple shaped charges 310 on the same plane to further improve hydraulic fracturing efficiency because of the short length require to place perforations all around the casing. This arrangement may benefit hydraulic fracturing operations in horizontal wells where the well direction is perpendicular to the preferred fracturing plane, typical of modern horizontal wells. For scenarios where perforations are generated on the same plane along the well casing, hydraulic fluid injected into the perforations will initiate the same fracture plane within the reservoir and will experience lower fluid tortuosity. This may, in effect, result in lower breakdown pressures for fracture initiation as compared to conventional perforating gun designs that locate single conical shaped charges at separate axial locations along the perforating gun. In the context of oilfield hydraulic fracturing, breakdown pressure refers to the hydraulic pressure required to begin or initiate fractures in a reservoir. Lower breakdown pressures may result in lower horsepower pumping capacity requirements from surface equipment, and therefore lower cost.

Some gun phases that are widely used for hydraulic fracturing operations are 60-degree and 120-degree. These two phases have become the common for hydraulic fracturing operations because they have been recognized to help reduce the risk of creating undesirable competing fractures and minimize fluid tortuosity, particularly in vertical wells. For hydraulic fracturing of horizontal wells, the 120-degree gun phasing may be advantageous over the 60-degree gun phasing in some situations because a shorter perforating interval is required to cover the whole circumference of the well as illustrated in FIG. 9.

SUMMARY OF THE INVENTION

A self-positioning system for a perforating gun or gun string is provided. In one embodiment, the self-positioning system includes a plurality of protrusions extending outwardly from the perforating gun or the gun string for providing a finite number of rotational positions and/or for providing a desired water clearance. The protrusions include one or more groupings of at least three protrusions, the protrusions being angularly offset from each other about the outer circumference of the perforating gun or the gun string.

In one embodiment, the plurality of protrusions include at least three protrusions that are axially aligned with each other and that are angularly offset from each other about an outer circumference of the gun carrier. The protrusions can comprise N-number of protrusions oriented at about 360/N-degree intervals around the outer circumferences of the gun carrier, thereby providing N-number of rotational positions of the gun carrier when within an inclined or horizontal well-bore. For example, the plurality of protrusions can include three protrusions at about 120-degree intervals or four protrusions at about 90-degree intervals around the outer circumferences of the gun carrier. The ratio of the radial height of the plurality of protrusions to the outer diameter of the cylindrical sidewall is between 1:3 and 1:25, inclusive, such that the gun carrier is optionally spaced apart from the wellbore casing.

In another embodiment, each perforating gun includes a loading tube that is rotatable within the gun carrier and includes an asymmetric weight for achieving a desired angular orientation of the shaped charges when inclined at least 45 degrees from vertical within a wellbore. The gun carrier includes first and second electrically conductive rotating pins that are rotatably seated within first and second internal adaptors, the first and second internal adaptors being coupled to opposing ends of the loading tube.

In another embodiment, a gun string is provided. The gun string includes first and second perforating guns and an external adapter. A plurality of protrusions extend outwardly from the gun string, including for example a first grouping of at least three protrusions from the first perforating gun and a second grouping of at least three protrusions from the second perforating gun. The protrusions of the first perforating gun are maintained in angular alignment with the protrusions of the second perforating gun, providing the gun string with finite rotational positions of the gun carrier within an inclined or horizontal well-bore.

In another embodiment, the external adaptor includes an alignment mechanism to maintain the shaped charges of the first perforating guns in angular alignment with the shaped charges of the second perforating gun. The alignment mechanism is optionally a pin-and-slot attachment for coupling opposing ends of the external adaptor to the first and second perforating guns. The external adaptor can include a plurality of protrusions extending outwardly therefrom. The plurality of protrusions are angularly offset from each other about the outer circumference of the external adaptor, such that the plurality of protrusions are oriented at different angles about the external adaptor.

In another aspect of the invention, a method is provided. The method includes providing a gun string including first and second perforating guns and an external adaptor coupled therebetween, the gun string further including at least three protrusions that are angularly offset from each other about an outer circumference of the gun string. The method further includes positioning the gun string within an inclined or substantially horizontal wellbore, such that the gun string is positioned in one of a finite number of rotational positions that create fixed gun-to-casing water clearances for the perforations. The method then includes detonating the shaped charges from the first and second perforating guns for penetrating a wellbore casing. The perforating guns optionally include a loading tube having an asymmetric weight for achieving a desired angular orientation of shaped charges when the gun string is inclined or substantially horizontal.

These and other features and advantages of the present invention will become apparent from the following description of the invention, when viewed in accordance with the accompanying drawings and appended claims.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

The subject matter described here is a gun system with mechanical features that, in horizontal or deviated wells, act to preferentially fix the rotation of the gun string and its shaped charges with respect to the casing with a finite number of fixed rotational positions. The rotational position achieved by the system creates a limited number of predetermined, fixed water clearances opposite the shaped charges. Limiting and controlling the water clearances provides better predictability and control of the perforation hole sizes generated in the well casing.

Figure 1:
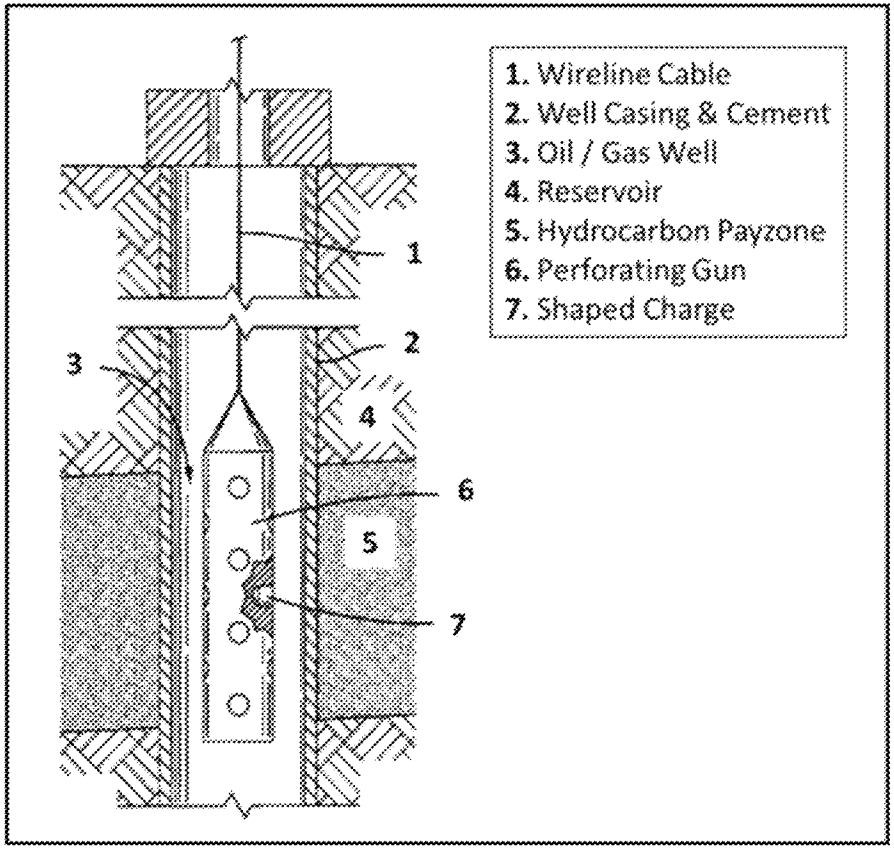
FIG. 1 (PRIOR ART)
FIG. 1 is a schematic diagram illustrating a hollow-carrier oilfield perforating gun within a well in accordance with the prior art.
Figure 2:
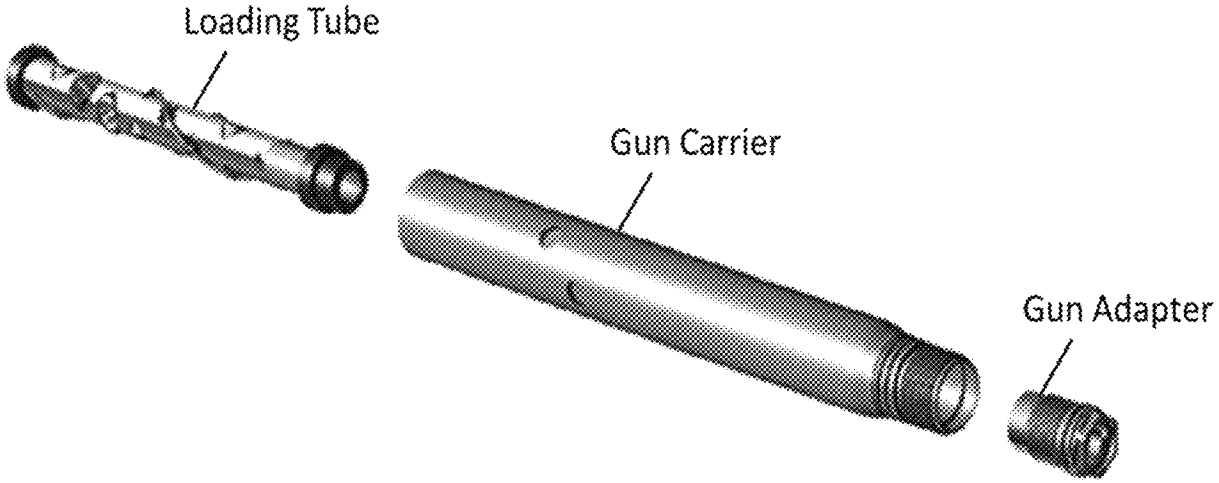
FIG. 2 (PRIOR ART)
FIG. 2 is a schematic diagram illustrating a hollow-carrier oilfield perforating gun in accordance with the prior art.
Figure 3:
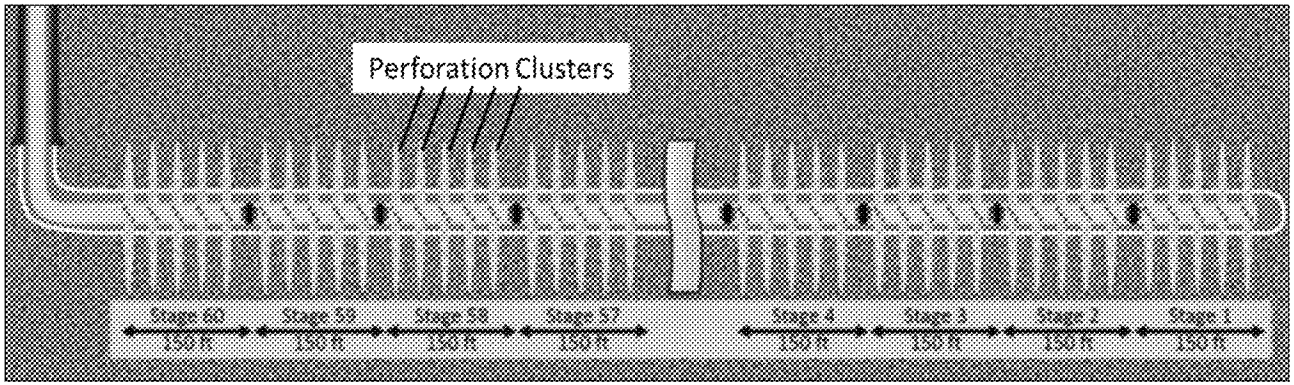
FIG. 3 (PRIOR ART)
FIG. 3 is a schematic diagram illustrating a method for hydraulically fracturing in a horizontal well in accordance with the prior art.
Figure 4:
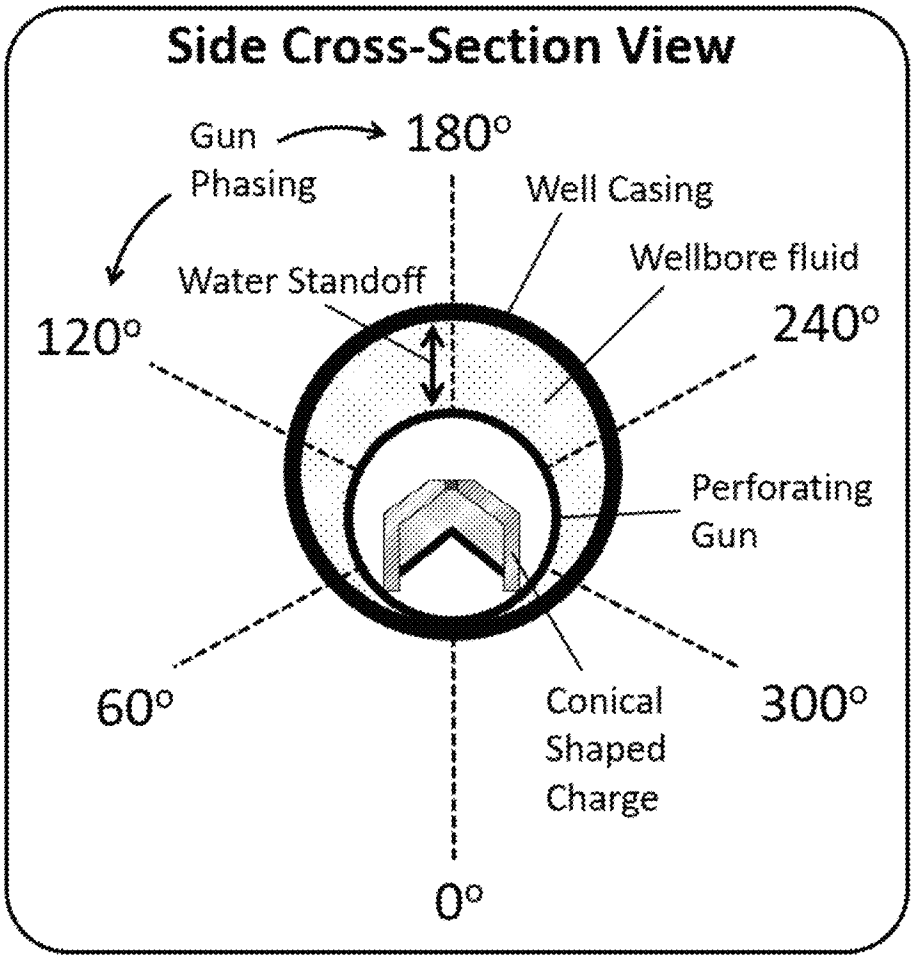
FIG. 4 (PRIOR ART)
FIG. 4 is a schematic diagram illustrating a perforating method in accordance with the prior art.
Figure 5:
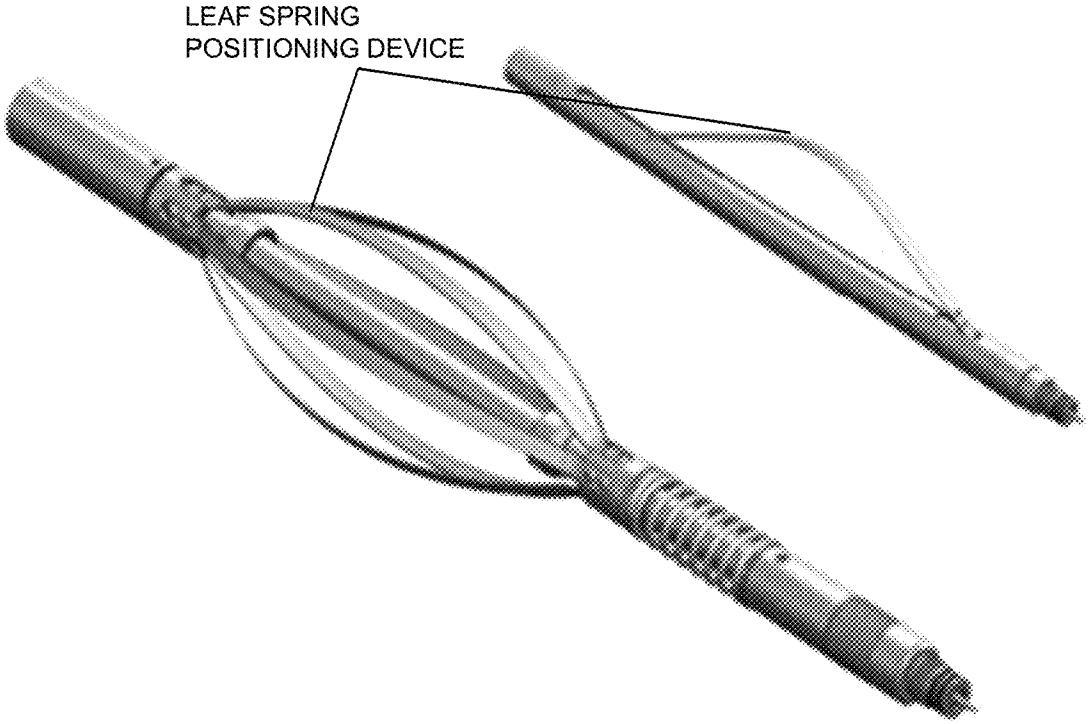
FIG. 5 (PRIOR ART)
FIG. 5 shows examples of existing positioning devices for downhole tools.
Figure 6:
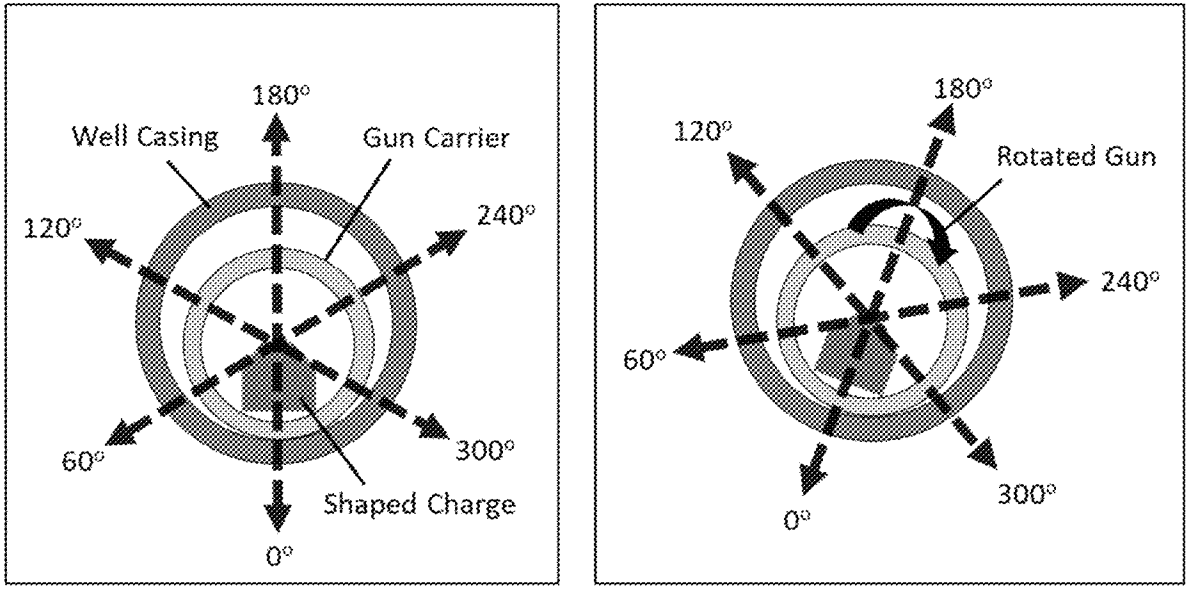
FIG. 6 illustrates the variable gun-to-casing water clearances produced by a rotating perforating gun in a well.
Figure 7:
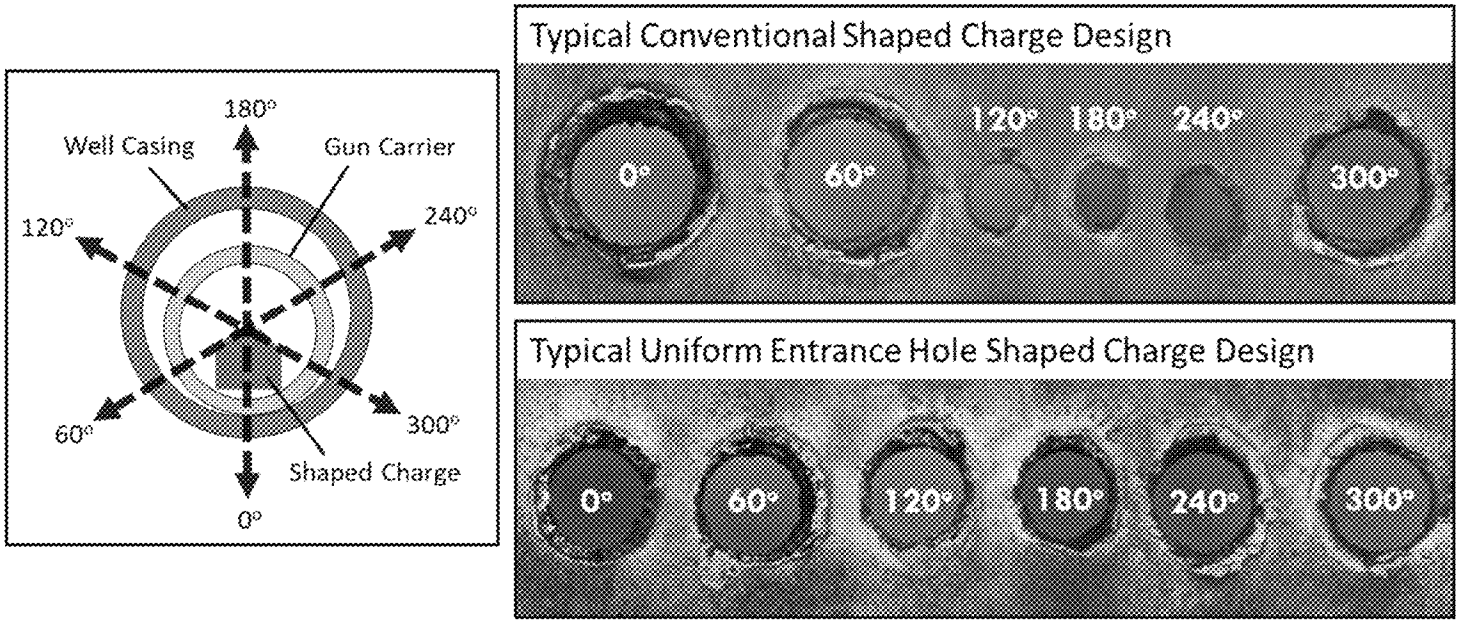
FIG. 7 is a picture that shows casing entrance hole diameters produces by different types of shaped charge designs.
Figure 8:
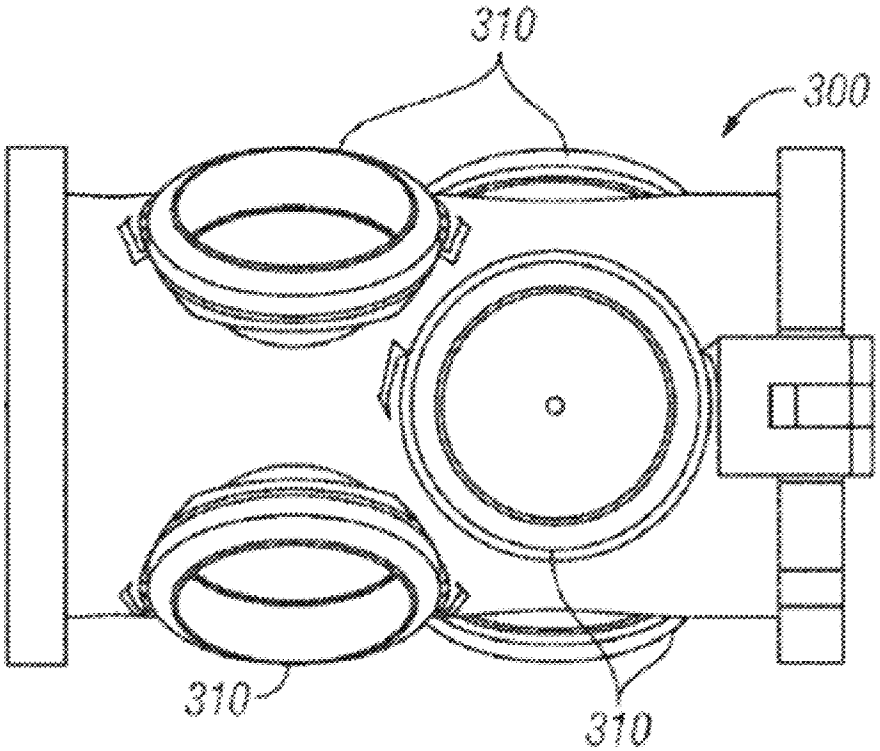
FIG. 8 (PRIOR ART)
FIG. 8 is a schematic of a perforating gun with three shaped charges located on the same plane.
Figure 9:
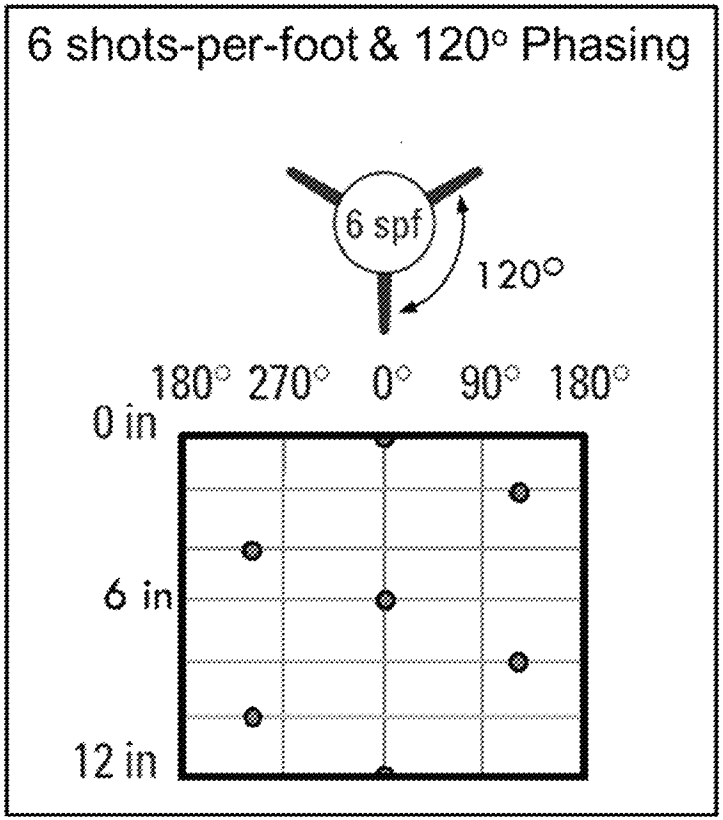
FIG. 9 is an illustration of the perforation patterns for 60-degree and 120-degree phased gun systems.
Figure 9:
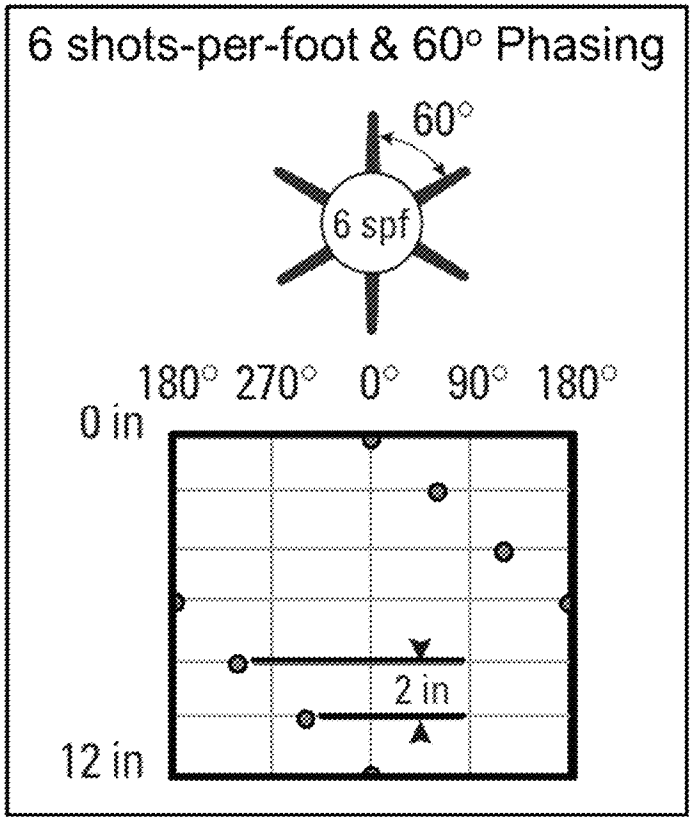
Figure 10:
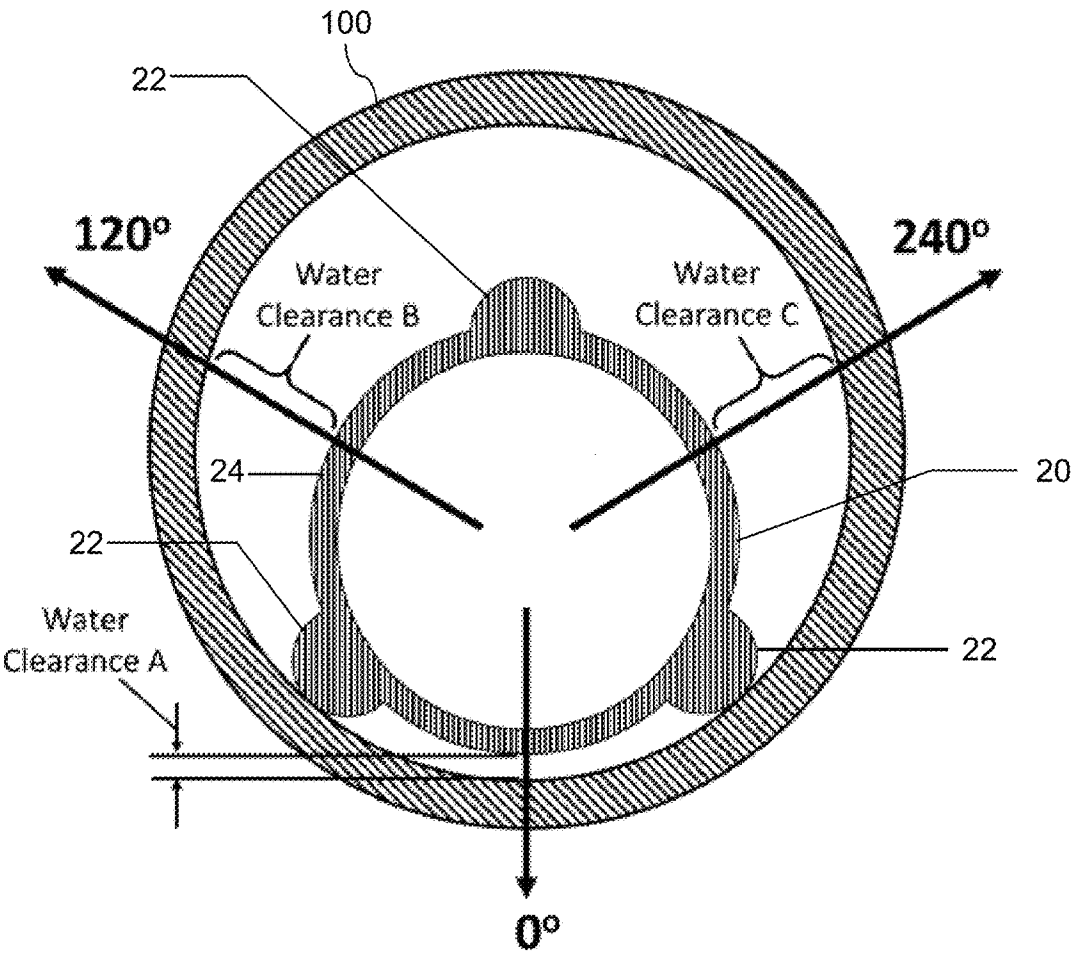
FIG. 10 is an illustration of a self-positioning gun system including a plurality of protrusions for achieving a water clearance.

FIG. 10 shows a cross-sectional view of an embodiment whereby a perforating gun 20 located inside a well casing 100 contains protrusions 22 that mechanically establish fixed water clearances. The protrusions 22 are axially aligned and comprise N-number of protrusions oriented at about 360/N-degree intervals around the outer circumferences of the gun carrier 24, thereby providing N-number of rotational positions of the gun carrier 24 within an inclined or horizontal well-bore 100. In this scenario, three protrusions 22 on the external body of the perforating gun 20 are placed at 120-degrees from each other, thereby providing three rotational positions of the gun carrier 24. In the absence of the protrusions, the gun system is not constrained and thereby may orient the charges in any fashion to yield varying water clearances between the 0-degree and 180-degree phases. However, a perforating gun with the above-mentioned protrusions will have fixed rotational positions and therefore limited number of water clearances. During conveyance of the perforating gun string into a well, the gun string is free to rotate as it traverses the vertical section of the well. As it transitions into the deviated and horizontal sections of the well, however, gravity forces the gun string to become oriented in a stable position as detailed in FIG. 10. The arrangement of the protrusions shown in FIG. 10 limits the gun system to only two perforation water clearances. The perforations at 120-degree and 240-degree phases have the same water clearance, while the other water clearance is located at the 0-degree phase. Two important advantages of dealing with fewer perforation water clearances are: (1) the design and optimization of a uniform-hole shaped charge is less difficult, and (2) the standard deviation of the casing entrance hole diameter is significantly improved.

The protrusions 22 shown in FIG. 10 also create a standoff between the gun 20 and the casing 100, ensuring that no perforations are made where the gun is in contact with the casing. When a shaped charge creates a perforation, a metal burr is commonly generated on the outside profile of the perforating gun. When a perforation is located where the gun is up against the well casing, the burr can extend into the perforation hole created in the well casing. This in effect can cause the gun to become stuck. Burrs along the gun can also cause increased friction and damage to the well casing when the gun system is conveyed out of the well after the perforating operation. A common solution for this issue is to have circular cutouts, also referred to as "scallops", on the external surface of the perforating guns at locations corresponding to where the shaped charges are positioned and the perforations will be produced. When the linear jet formed by the conical shaped charge passes through a scallop region on the gun, the burr that is produced is less likely to extend beyond the diameter of the perforating gun. By naturally creating a standoff between the gun and casing, the protrusions described here and shown in FIG. 10 enable the use of lower cost perforating guns that do not have scallops. Scallop-less perforating guns, also referred to as "slick guns", have lower manufacturing cost owing to fewer machining requirements on the gun carrier.

The gun system shown in FIG. 10 contains three protrusions 22 and locates the shaped charges 60-degrees out of phase with respect to the protrusions. It can be appreciated, however, that a variety of scenarios can be applied related to phasing of the shaped charges relative to the protrusions. As an example, the shaped charges in FIG. 10 can be located in the same phase as the protrusions 22 and the two water clearances would be at the 180-degree phase and the 60-degree/300-degree phases. Likewise, the charges can be rotated 30-degrees from what is shown in FIG. 10, in which case there would exist three fixed water clearances: at the 30-degree, 150-degree, and 270-degree phases or 90-degree, 210-degree, and 330-degree phases.

A similar gun positioning system can also be achieved with 4 protrusions at 90-degrees from each other, or, in general, with "N" protrusions at 360/N degrees from each other. Provided that the shaped charges are located at fixed positions relative to the protrusions, the location of the charges with respect to the well casing is controlled to a limited number of predictable water clearances.

Figure 11:
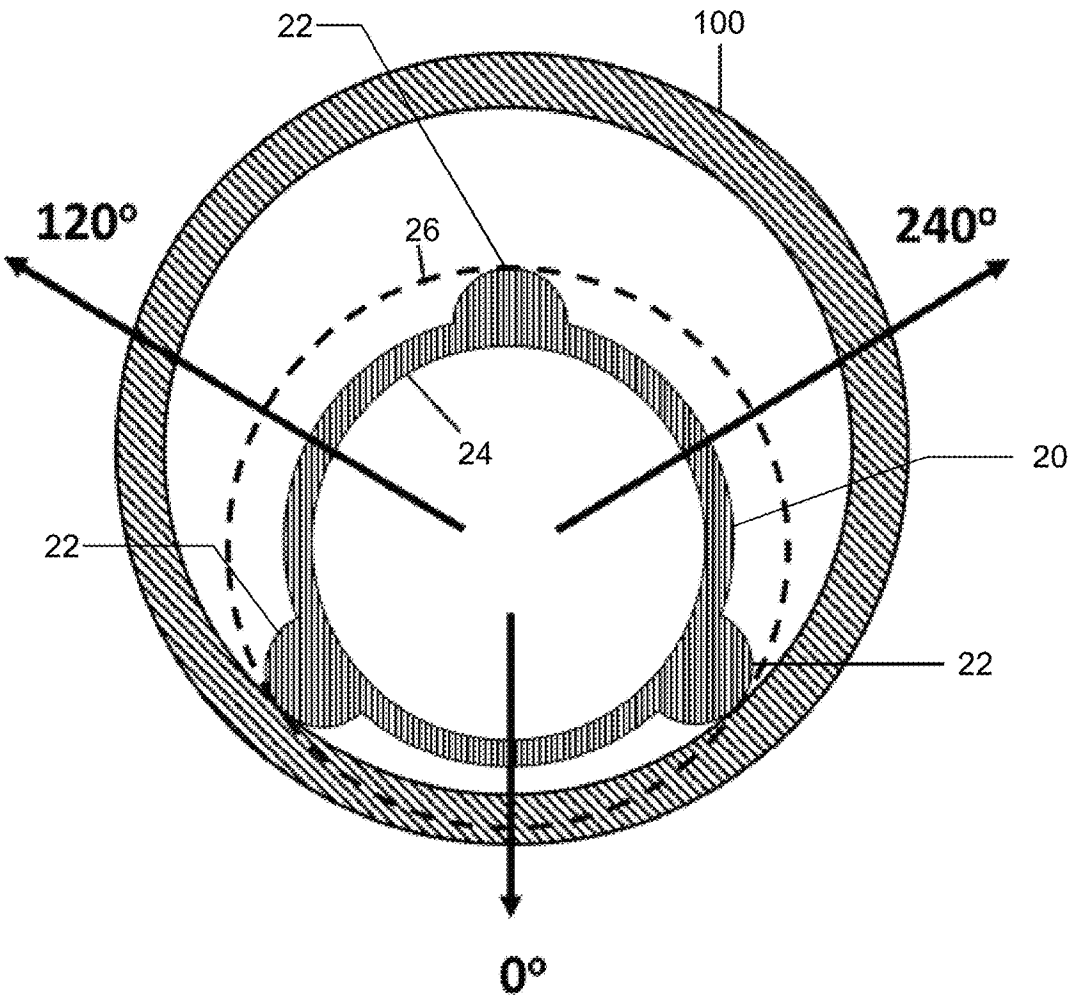
FIG. 11 is a further illustration of a self-positioning gun system including a plurality of protrusions for achieving a water clearance.

The size of the protrusions 22 can be selected to achieve the desired water clearances, or even zero water clearance, but the size is limited by the overall envelope 26 of the gun as shown in FIG. 11. The overall envelope of the gun is established by identifying the smallest circle that will encompass the full cross-section of the gun system including the protrusions. If the overall envelope of the gun system is too large, then the gun system will not be able to pass through the completion restrictions that may exist in the well. The ratio of the radial height of the plurality of protrusions to the outer diameter of the cylindrical sidewall can be between 1:3 and 1:25, inclusive, such that the outer surface of the gun carrier is sufficiently spaced apart from the wellbore casing. For example, for a typical horizontal well with a 5.5" outer-diameter casing commonly used in unconventional reservoirs, protrusions extending approximately 0.336" from a 3.125" outer-diameter gun system would provide a gun-to-casing standoff of approximately 0.1" and an overall gun envelop of about 3.375". In this example, the ratio of the radial height of the plurality of protrusions to the outer diameter of the cylindrical sidewall is about 1:9. For reference, overall gun envelopes smaller than approximately 4.25" should be adequate for the majority of mono-bore completions of horizontal wells with the 5.5" outer-diameter well casing size, so an envelope of 3.375" is acceptable for this particular scenario. Similarly, other dimensions of the protrusions can be selected for other casing sizes, gun sizes, or completion types.

Figure 12:
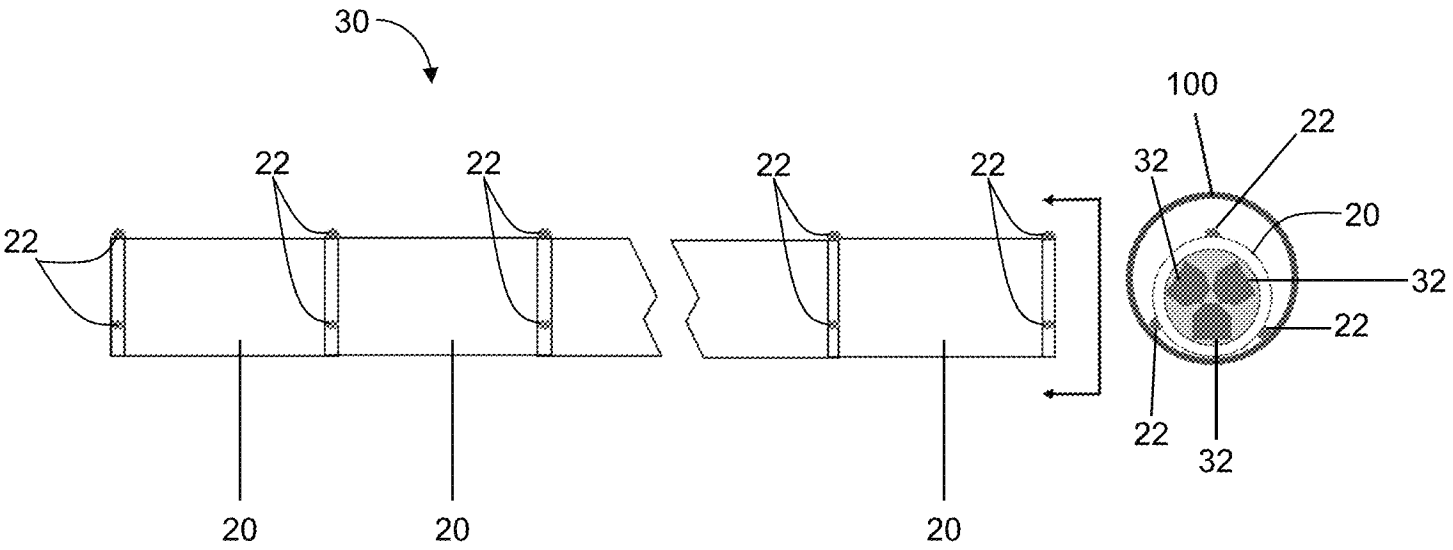
FIG. 12 is an illustration of a self-positioning gun system including a plurality of perforating guns each having a plurality of protrusions.

A further feature is the alignment of the protrusions with respect to the shaped charges inside the gun, and the alignment of each gun in the gun string 30. FIG. 12 shows an example where three protrusions are placed at 120 degrees from each other, with an offset of 60 degrees from the shaped charges 32. The mechanical connection between the guns 20 is designed to assure that the same alignment is maintained along all the guns 20 in the string. In certain scenarios, however, it may be advantageous to have the alignment between the protrusions and the shaped charges 32 at a different angle. The angle selected between the protrusions 22 and the shaped charges 32 remains fixed in order to establish predictable water clearances for the shaped charges. Having a known, limited number of water clearances in turn facilitates the design and optimization of the shaped charges 32 used in the gun system.

Figure 13:
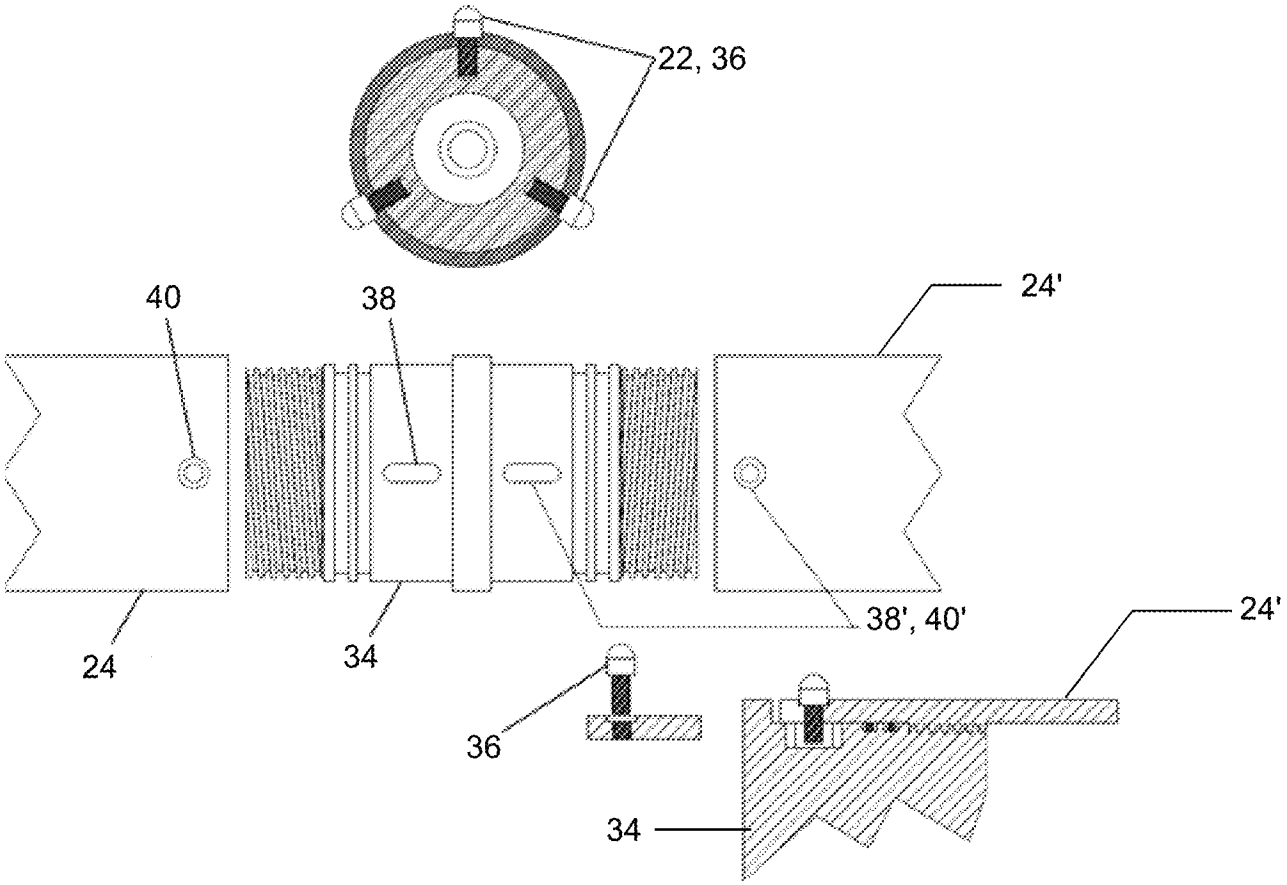
FIG. 13 is an illustration of a self-positioning gun system including an external adaptor with a pin-and-slot attachment for adjacent gun carriers.
Figure 14:
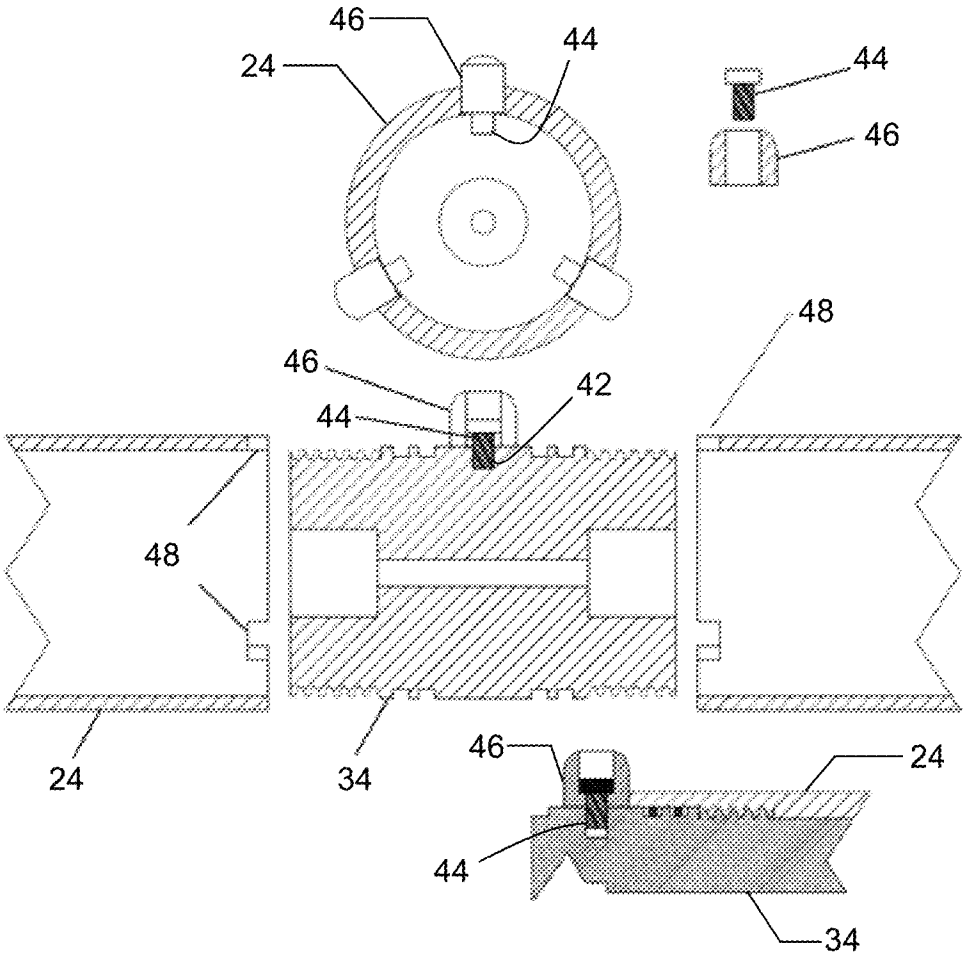
FIG. 14 is an illustration of a self-positioning gun system including protrusions extending from an external adaptor.

As shown in FIG. 12, the protrusions 22 along the gun string 30 are aligned with each other to ensure that the protrusions 12 properly orient each perforating gun 20 in the gun string 30. It follows that, since each gun contains its own protrusions, proper alignment of the guns is achieved. Alignment of the guns can be achieved in a variety of manners. One approach is to incorporate alignment features into the gun body itself, such that the protrusions 22 extend outwardly from the gun carrier 24, or with a gun-to-gun adaptor. FIGS. 13 and 14 shows a mechanical connection (external adaptor 34) between adjacent guns 20 that accomplishes alignment from one gun to the next using bolts 36 that also serve as the protrusions 22. In FIG. 13, the external adaptor 34 includes six alignment slots 38. Three alignment slots 38 are arranged at 120-degree intervals and coincide with three alignment holes 40 in the first gun carrier 24, and three alignment slots 38' are arranged at 120-degree intervals and coincide with three alignment holes 40' in the second gun carrier 24'. The alignment holes 40, 40' are in reference to the gun scallops, such that the shaped charges are consistently oriented for each gun 20 in the gun string 30. In FIG. 14, the external adaptor 34 includes three threaded openings 42 oriented at 120-degree intervals. Each opening 42 receives an externally threaded bolt 44, which extends through a raised button 46. The raised button 46 is held in position by the bolt 44, such that the raised button 46 functions as the protrusion 22. Indexing slots 48 in the gun carrier 24 extend around each bolt 44 to ensure each perforating gun is properly aligned.

Figure 15:
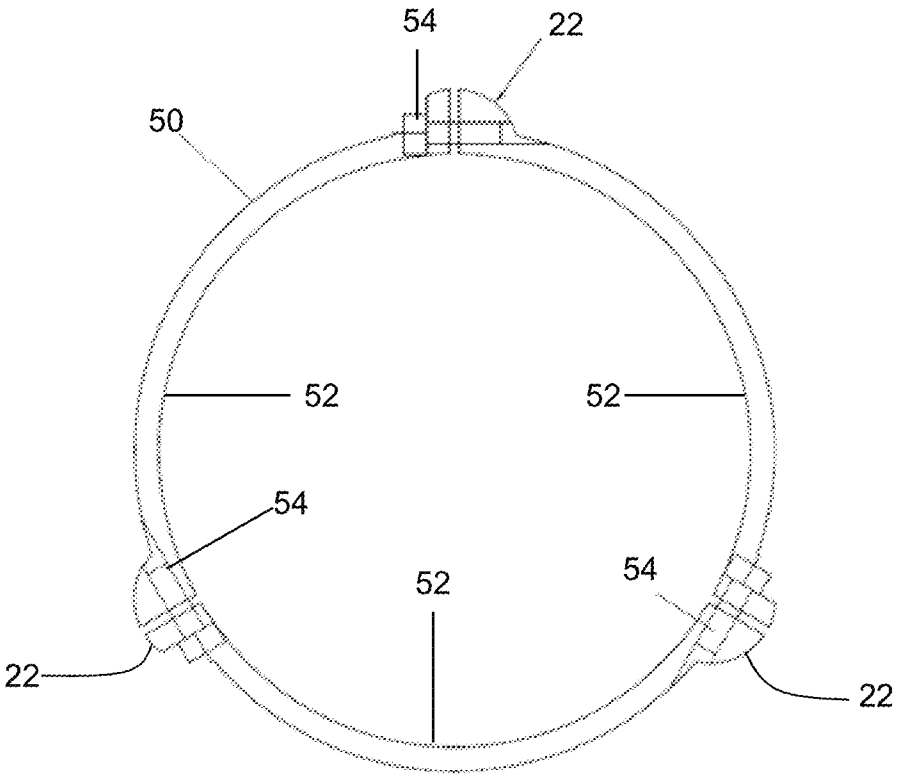
FIG. 15 is an illustration of an alignment ring for a self-positioning gun system.
Figure 16:
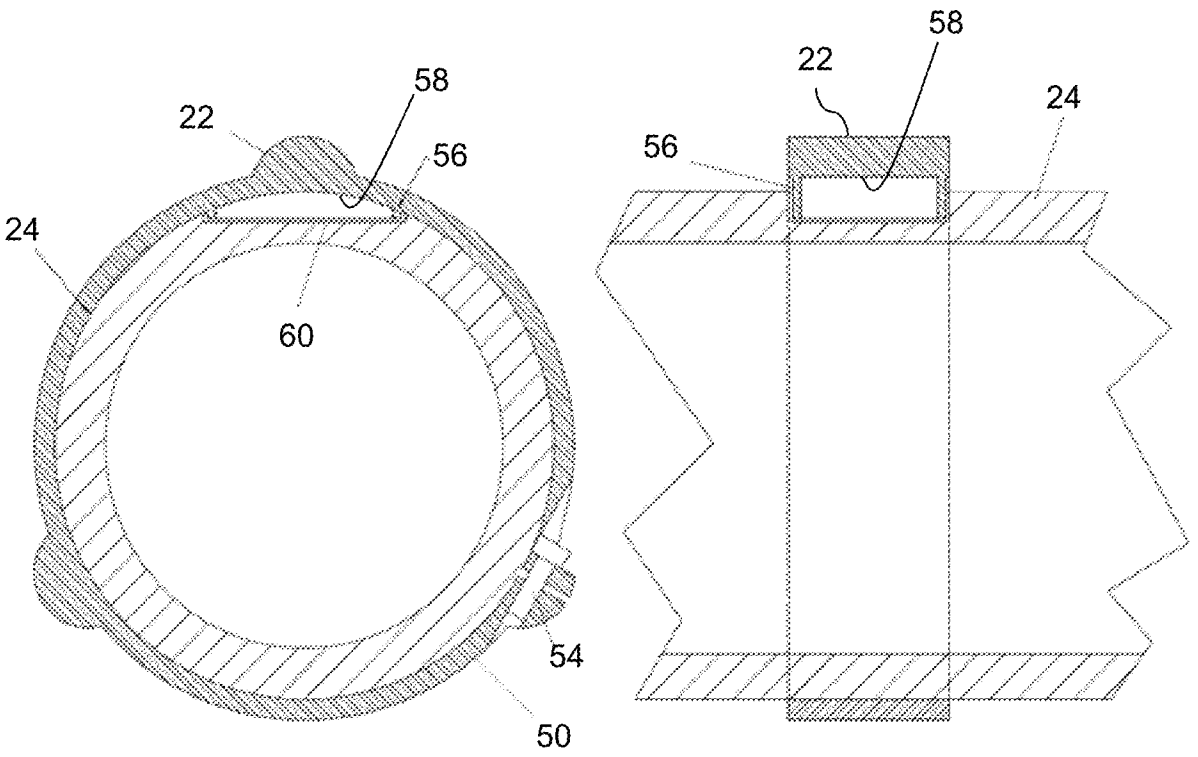
FIG. 16 is a further illustration of an alignment ring for a self-positioning gun system.

Alignment can also be accomplished with an alignment ring 50 installed on the gun carriers or gun adaptors. FIG. 15 shows an embodiment of an alignment ring 50 containing the protrusions 22. Each alignment ring 50 in this embodiment includes a cylindrical collar comprising three ring segments 52 which are held together with three bolts 54. The alignment ring 50 forms a protrusion 22 where the ring segments 52 meet. The ring 50 can be installed on existing perforating gun carriers or gun adapters. FIG. 16 shows an embodiment of an alignment ring 50 with an internal indexing feature 56 used to align the ring 50 with an existing scallop on a perforating gun. In particular, the inner annular surface 58 of the alignment ring 50 includes a raised feature 56 for a corresponding scallop 60 in external surface of the gun carrier 24. This embodiment takes advantage of the fact that gun scallops are inherently aligned with the shaped charges. Alternatively, the external adaptor 34 can define a scallop 60 in its exterior surface in embodiments where the alignment ring 50 extends around the external adaptor 34, rather than the gun carrier 24. Further alternatively, the gun carrier 24 or the external adaptor 34 can include a raised feature and the alignment ring 50 can include a corresponding recess, which ensures that the alignment ring 50 is positionable with a single orientation.

In horizontal wells, longer perforating guns (which can extend up to 20-feet) are susceptible to gravity-induced bending or sagging if the ends of the gun barrels are lifted off the well casing by a standoff. For multi-stage hydraulic fracturing of horizontal wells, however, the individual perforating intervals are typically no more than 2-ft in length allowing for the use of shorter perforating guns. It follows that gravity-induced bending is not a concern for shorter perforating guns less than 5-feet in length owing to the shorter deflection distance between the ends of the gun. Therefore, the use of protrusions at the ends of the shorter guns will maintain a suitable standoff from the well casing.

Figure 17:
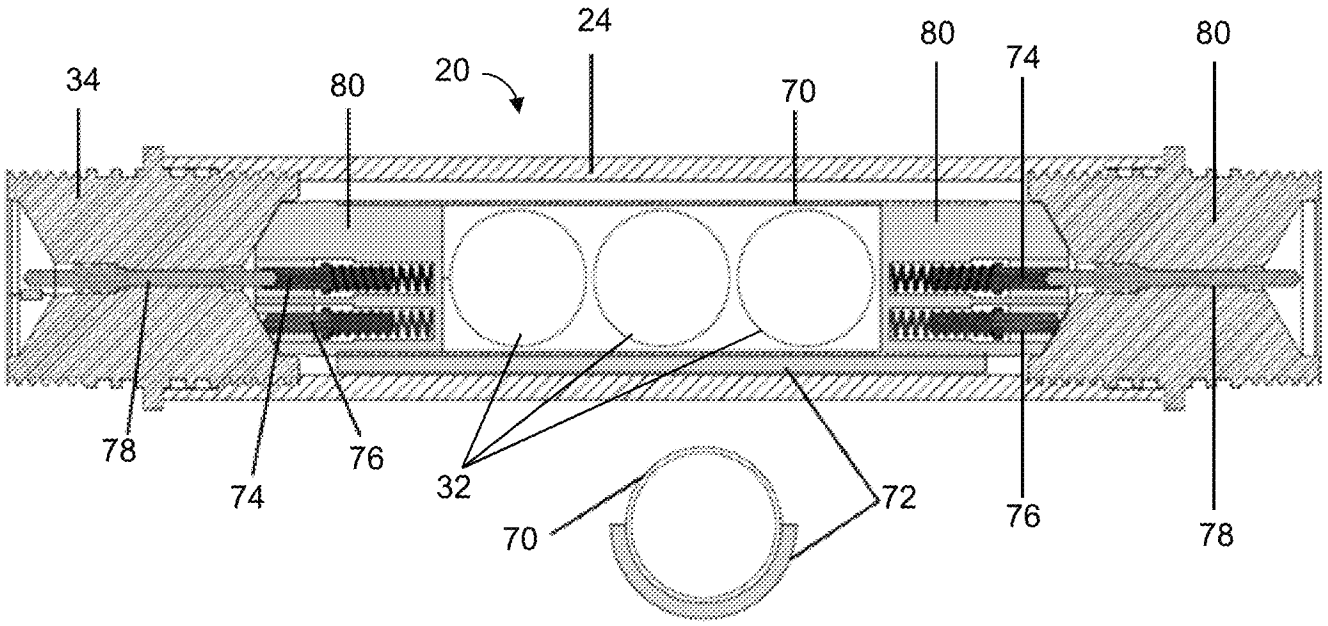
FIG. 17 is an illustration of a self-positioning gun system including a loading tube having an asymmetric weight.

Another method for preferentially positioning shaped charges within a horizontal or deviated well is shown in FIG. 17. This method utilizes a freely rotating loading tube 70 that optionally contains an asymmetrical weight 72. The system depicted in FIG. 17 includes a low-friction swivel mechanism between the loading tube 70 and the gun carrier 24. The action of gravity on the freely rotating loading tube 70 causes the loading tube 70 to orient itself in the most stable position. The use of an asymmetrical weight 72 attached to the loading tube 70 may improve consistency of the system and allows for different charge orientations to be achieved. Alignment between gun carriers is not required with this embodiment because the loading tube assembly is oriented autonomously.

For the embodiment shown in FIG. 17, electrical connectivity to the detonator is established through the rotating pin 74 and the grounding pin 76. The rotating pin 74 serves a dual function as (1) an axis of rotation for the loading tube assembly and (2) an electrical connector. The firing current for the detonator (not shown) is supplied from the upwell gun via the transfer pin 78. The transfer pin 78 is electrically insulted from the external adapter 34 since the external adapter 34 is electrically grounded. The firing current passes from the transfer pin 78, through the rotating pin 74, and then to the internal adapter 80 where the detonator is housed. The electrical ground for the detonator is achieved through connection of the internal adapter 80 to the electrically grounded external adapter 34 via the spring-loaded grounding pin 76. The spring-loaded grounding pin 76 is able to maintain contact with the external adapter 34 while the internal adapters 80 and loading tube 70 freely rotate.

It has been established through testing of conventional shaped charge designs (as opposed to uniform entrance hole charge designs) that avoiding certain water clearances can be beneficial. For a particular shaped charge design, it was observed that elimination of the 60-degree, 180-degree, and 300-degree phases would reduce the entrance hole standard deviation from 34.1% to 8.4%. For a separate shaped charge design, testing identified that elimination of the 0-degree, 120-degree, and 240-degree phases would decrease the entrance hole standard deviation from 16.0% to 0.6%. These significant improvements in standard deviation illustrate the benefit of the novel mechanical features presented.

To reiterate, the above embodiments provide a gun string 30 having a plurality of protrusions 22 for providing a finite number of rotational positions of the gun string 30 and/or for providing the desired water clearance with respect to a wellbore casing 100. The protrusions 22 include axially spaced-apart groupings of at least three protrusions each, the protrusions 22 (within each grouping) being angularly offset from each other about the outer circumference of the gun string 30. For example, each perforating gun 20 can include a grouping of three or more protrusions 22 that are angularly offset from each other and/or each external adaptor 34 can include three or more protrusions 22 that are angularly offset from each other and/or each alignment ring 50 can include a grouping of three or more protrusions 22 that are angularly offset from each other. In these and other embodiments, the protrusions 22 can be fixed relative to the internal shaped charges 32. In other embodiments, the shaped charges 32 can be angularly offset with respect to the outward protrusions 22. As shown in FIG. 17 example, each perforating gun 20 includes a loading tube 70 that is rotatable with respect to the gun carrier 24. The loading tube 70 can include an asymmetric weight 72 for providing a desired orientation of the shaped charges 32 when the perforating gun 20 is inclined from vertical or substantially horizontal. First and second electrically conductive rotating pins 74 are rotatably seated within the first and second internal adaptors 80. As noted above, the firing current passes from through the rotating pin 74 to the internal adapter 80 where the detonator is housed. The spring-loaded grounding pin 76 maintains contact with the external adapter 34 while loading tube 70 rotates, thereby providing a connection to electrical ground (the external adaptor 34) even as the loading tube 70 rotates within the gun carrier 24.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A self-positioning perforating gun comprising:

a gun carrier including a cylindrical sidewall defining an outer surface;

a loading tube received within the gun carrier, the loading tube including a plurality of shaped charges; and a plurality of protrusions extending outwardly from the gun carrier, the plurality of protrusions including at least three protrusions that are angularly offset from each other about an outer circumference of the gun carrier cylindrical sidewall for providing finite rotational positions of the gun carrier within a wellbore and/or for spacing the outer surface of the cylindrical sidewall from a wellbore casing, wherein the plurality of shaped charges are angularly offset from the plurality of protrusions.

2. The perforating gun of claim 1 wherein the plurality of protrusions includes N-protrusions at about 360/N-degree intervals about the outer circumference of the gun carrier.

3. The perforating gun of claim 1 wherein the plurality of protrusions includes three protrusions at about 120-degree intervals about the outer circumference of the gun carrier.

4. The perforating gun of claim 1 wherein each the plurality of protrusions define a uniform radial height and wherein the cylindrical sidewall defines an outer diameter, the ratio of the radial height of the plurality of protrusions to the outer diameter of the cylindrical sidewall being between 1:3 and 1:25, inclusive.

5. A self-positioning perforating gun comprising:

a gun carrier including a cylindrical sidewall defining an outer surface;

a loading tube received within the gun carrier, the loading tube including a plurality of shaped charges; and a plurality of protrusions extending outwardly from the gun carrier, the plurality of protrusions including at least three protrusions that are angularly offset from each other about an outer circumference of the gun carrier cylindrical sidewall for providing finite rotational positions of the gun carrier within a wellbore and/or for spacing the outer surface of the cylindrical sidewall from a wellbore casing, wherein the loading tube is rotatable within the gun carrier and includes an asymmetric weight for achieving a desired angular orientation of the plurality of shaped charges when the cylindrical casing is inclined at least 45 degrees from vertical.

6. The perforating gun of claim 5 further including first and second electrically conductive rotating pins that are rotatably seated within first and second internal adaptors, the first and second internal adapters being coupled to opposing ends of the loading tube.

7. A self-positioning perforating gun system comprising:

a gun string including first and second perforating guns, each of the first and second perforating guns including:

a gun carrier including a cylindrical sidewall defining an outer surface, a loading tube received within the gun carrier, the loading tube including a plurality of shaped charges; and a plurality of protrusions extending outwardly from the gun string, the plurality of protrusions being angularly offset from each other about an outer circumference of the gun string, wherein the plurality of protrusions of the first and second perforating guns are in angular alignment with each other, wherein the gun string further includes an external adapter that is coupled between the first and second perforating guns, the external adapter including an alignment mechanism to maintain the plurality of protrusions of the first and second perforating guns in angular alignment with each other.

8. The system of claim 7 wherein the alignment mechanism includes a pin-and-slot attachment for coupling opposing ends of the external adapter to the first and second perforating guns.

9. A method comprising:

providing a gun string including first and second perforating guns and an external adaptor, each of the first and second perforating guns including:

a gun carrier including a cylindrical sidewall, a loading tube received within the gun carrier, the loading tube including a plurality of shaped charges, and a plurality of protrusions extending outwardly from the gun string and being angularly offset from each other about an outer circumference of the gun string, wherein the plurality of shaped charges are angularly offset from the plurality of protrusions;

positioning the gun string within a wellbore such that the plurality of protrusions of the first and second perforating guns are in angular alignment with each other; and detonating the plurality of shaped charges.

10. A method comprising:

providing a gun string including first and second perforating guns and an external adaptor, each of the first and second perforating guns including:

a gun carrier including a cylindrical sidewall, a loading tube received within the gun carrier, the loading tube including a plurality of shaped charges, and a plurality of protrusions extending outwardly from the gun string and being angularly offset from each other about an outer circumference of the gun string, positioning the gun string within a wellbore such that the plurality of protrusions of the first and second perforating guns are in angular alignment with each other; and detonating the plurality of shaped charges, wherein the loading tube is rotatable within the gun carrier and includes an asymmetric weight for achieving a desired angular orientation of the plurality of shaped charges when the gun string is substantially horizontal.

11. A self-positioning perforating gun system comprising:

a gun string including first and second perforating guns and an external adaptor; and at least one alignment ring extending around a circumferential portion of the gun string, the alignment ring including a cylindrical collar and a plurality of protrusions extending outwardly from the cylindrical collar, wherein each of the plurality of protrusions are angularly offset from each other about the cylindrical collar, wherein the at least one alignment ring includes an inwardly-protruding indexing feature and wherein the gun string includes a corresponding recess to maintain the alignment ring in a single angular orientation about the gun string.

12. The system of claim 11 wherein the at least one alignment ring is disposed about the external adaptor.

13. The system of claim 11 wherein the at least one alignment ring includes a first alignment ring disposed about the first perforating gun and a second alignment ring disposed about the second perforating gun.

14. A self-positioning perforating gun comprising:

a gun carrier including a cylindrical sidewall;

a loading tube that is concentrically received within the gun carrier and rotatable with respect to the cylindrical sidewall;

first and second internal adaptors, the first and second internal adaptors being coupled to opposing ends of the loading tube;

a plurality of shaped charges within the loading tube, the loading tube including an asymmetric weight for achieving a desired angular orientation of the plurality of shaped charges when the gun carrier is inclined from vertical by at least 45-degrees; and first and second electrically conductive rotating pins that are rotatably seated within the first and second internal adaptors, respectively.

15. The perforating gun of claim 14 further including first and second grounding pins that are seated within longitudinal openings in the first and second internal adaptors, respectively, the first and second grounding pins being biased against respective first and second external adaptors that are joined to opposing ends of the gun carrier.

16. The perforating gun of claim 14 further including a plurality of protrusions extending outwardly from the gun carrier for spacing the cylindrical sidewall from a wellbore casing, the plurality of protrusions including at least three protrusions that are angularly offset from each other about an outer circumference of the gun carrier.

* * * * *